US005878967A

United States Patent [19]

Conner

[11] Patent Number: 5,878,967

[45] Date of Patent: Mar. 9, 1999

[54] PORTABLE SCREEN PLANT

[75] Inventor: Edward L. Conner, Medina, Ohio

[73] Assignee: Ohio Machinery Company, Broadview Heights, Ohio

[21] Appl. No.: 844,974

[22] Filed: Apr. 23, 1997

[51] Int. Cl.[6] ..... B02C 21/02

[52] U.S. Cl. ..... 241/79.1; 209/935; 241/101.76

[58] Field of Search ..... 209/935, 931, 209/930; 241/79.1, 101.76, 101.77, DIG. 35, 99, 79

[56] References Cited

U.S. PATENT DOCUMENTS

| | | | |
|---|---|---|---|
| 3,563,477 | 2/1971 | Schroeder . | |
| 3,927,839 | 12/1975 | Quinn . | |
| 4,084,496 | 4/1978 | Ehernberger et al. | 241/99 |
| 4,383,651 | 5/1983 | Couperus . | |
| 4,585,179 | 4/1986 | Tsuji et al. . | |
| 4,598,875 | 7/1986 | Bronson et al. . | |
| 4,655,402 | 4/1987 | Desourdy . | |
| 4,795,103 | 1/1989 | Lech | 241/101.76 |
| 4,881,691 | 11/1989 | Oldengott et al. . | |
| 4,951,885 | 8/1990 | Thiis . | |
| 5,026,205 | 6/1991 | Gorski et al. . | |
| 5,161,744 | 11/1992 | Schoop et al. . | |
| 5,230,475 | 7/1993 | Gerner | 241/101.76 |
| 5,333,738 | 8/1994 | Fuchs et al. | 209/935 |
| 5,647,545 | 7/1997 | Conner | 241/101.76 |

*Primary Examiner*—Mark Rosenbaum

*Attorney, Agent, or Firm*—Pearne, Gordon, McCoy & Granger LLP

[57] ABSTRACT

A portable screen plant for use with a portable crusher for recycling demolition materials and like work. The plant includes a highway trailer on which is carried an upwardly inclined screen feed conveyor and classifying screens beneath the feed conveyor. The frame is articulated such that its forward end can be raised during screening operation to suspend a magnetic separator at a high elevation over a zone adjacent the discharge end of the screen feed conveyor. During transport, the front frame section and magnetic separator are at a lower elevation to provide adequate height clearance for highway travel. The screen feed conveyor is articulated on the trailer to improve road clearance during transport and afford efficient material flow during operation.

13 Claims, 2 Drawing Sheets

PORTABLE SCREEN PLANT

BACKGROUND OF THE INVENTION

The invention relates to material classifying equipment and in particular to a plant for classifying crushed solid material and magnetic material.

PRIOR ART

For economic and environmental reasons, it is becoming common to crush the rubble of buildings, pavement and other structures being demolished, usually at the site of the demolition. In the past, various processing equipment, frequently from the mining industry, has been employed to accomplish this task. Typically, however, such equipment is not readily transported so that time and labor is spent in rigging, transporting, erecting and/or assembling it in the field. Similarly, costs are incurred in dismantling the equipment for transport to the next job site or a home base.

The practicality of the on-site crushing approach has revealed the need for portable crushing and screening plants. Ideally, equipment should be transportable over public roads and, thus, be within certain height, width and weight limits.

Crushing building, pavement and like rubble can present the additional problem of handling steel reinforcing rod or wire as well as structural steel and pipe. Ideally, this steel should be separated from the crushed material so that it can be recycled and does not contaminate the crushed product or foul or jam the processing equipment. Practical arrangements for portable, i.e. roadway transportable, screen classifying plants are difficult to package. This situation is made more difficult when a magnetic separator is necessary for recovering scrap steel from the crushed product being delivered to a classifying screen.

SUMMARY OF THE INVENTION

The invention provides improvements in portable crushing and screening plants that are particularly suited for processing stone, brick, block, concrete, asphalt and like debris carrying or mixed with reinforcing bar and other steel elements from building or structural demolition. A screening plant constructed in accordance with the invention includes a screen feed conveyor that elevates crushed material from the discharge area of a crusher to the upper end of an inclined screen unit. A magnetic separator is deployed over the screen feed conveyor to separate steel scrap from the crushed material before this material is delivered to the screen elements. The magnetic separator is retractable from its operating position to reduce the height of the plant for highway transport.

In the preferred embodiment, the screen plant is carried on a single trailer. Material is received at the rear end of the trailer and is elevated by the screen feed conveyor running from the rear towards the front of the trailer. The trailer frame is hinged near the front so that it can pivot the magnetic separator from a relatively low transport position to a relatively high operating position. The disclosed articulated frame is simple in construction and operation. The location of the frame pivot or hinge axis is relatively high with respect to the ground and, consequently, allows the magnetic separator to be lifted through a distance sufficient to clear the high end of the screen feed conveyor without resort to complex linkages, complex joints, telescoping support frames or like constructions.

The organization of the screen plant with the pivotal frame section that supports the retractable and extendable magnetic separator affords a high level of operating efficiency. The pivotal frame section, when raised to its operational position, leaves a discharge area of a fines conveyor unobstructed. The discharge can therefore be easily tended by any desired equipment such as a wheeled loader or a stacking conveyor system, for example.

DESCRIPTION OF THE PREFERRED EMBODIMENT

Figure 1:
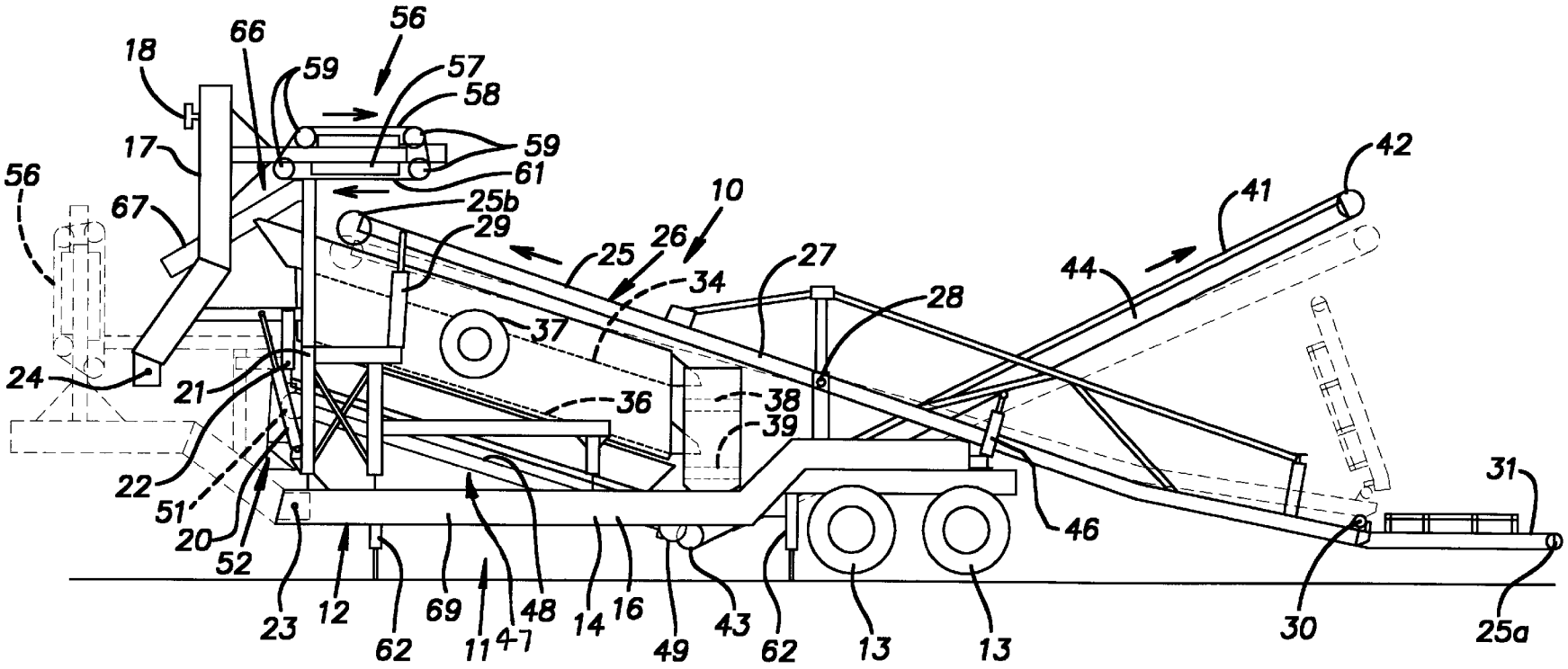
FIG. 1 is a somewhat schematic side elevational view of a screen plant embodying the invention.

A screen plant 10 includes a semi trailer 11 comprising a frame 12 and wheels 13. The frame 12 is a weldment of structural steel having parallel side rails 14 and suitable cross members. The wheels 13 are carried on axles supported on a rear section 16 of the frame in a conventional manner.

In FIG. 1, a front section 17 of the frame 12 is shown in a transport position in phantom and in an operating position in solid line. The front section 17 includes a conventional fifth wheel pin 18 for coupling the trailer 11 to a conventional highway tractor.

A support 21, formed as a weldment of structural steel, integral with the rear trailer section 16 includes hinge pins 22 at each side of the frame 12 on which the front frame section 17 is pivotally carried. The hinge pins 22 form a horizontal pivot axis perpendicular to the longitudinal or lengthwise direction of the trailer 11. For transport of the trailer, the front section 17 is releasably pinned to the rear section 16 (in phantom position in FIG. 1) by removable pins (not shown) at opposite sides of the trailer 11. The pins are received in alignable holes 23, 24 formed in respective rear and front trailer frame sections 16, 17 on both sides of the frame. The front frame section 17 is raised and lowered by pivoting it about the hinge pins 22 with hydraulically powered actuators 20 on each side of the frame 12.

An endless belt screen feed conveyor 26 assembled on the trailer 11 extends lengthwise, in alignment with the longitudinal direction of the trailer. The screen feed conveyor hangs rearwardly beyond and the rear frame section 16 and forwardly over this rear frame section. The conveyor 26 has a welded structural steel frame 27 that is inclined upwardly with reference to the forward direction so as to support an upper reach 25 of an endless belt with a similar inclination. The belt is trained about end pulleys 25*a*, 25*b*. The conveyor frame 27 is pivotally mounted on a horizontal pivot 28 transverse to the longitudinal direction of the trailer 11. Hydraulic actuators 29 are arranged to raise and lower the associated forward end of the conveyor 26 about the pivot 28. The operating position of the conveyor 26 is shown in solid line in FIG. 1 while the transport position is shown in phantom. By locating the trunnion or pivot 28 adjacent to the longitudinal center of the conveyor 26, the rear end of the conveyor is advantageously lowered while the front end is raised into the operating position and vise versa. In the operational position, this feature allows for a low elevation of a rear material receiving end 31 of the conveyor when positioned under the discharge apparatus of a crusher 32 (shown in phantom in FIG. 2) and a high elevation at the front for unobstructed material flow through the screen plant. Additionally, this feature allows for adequate road clearance at the rear 31 of the conveyor 26 and adequate height clearance at or below about 13' 6" at the front of the trailer 11 during transport. The tail end 31 of the conveyor 26 is pivoted at a horizontal hinge axis 30, enabling it to fold up to the phantom position in FIG. 1 during transport and to fold down to the solid line position for operation. This folding action is produced by a suitable hydraulic actuator (not shown).

A coarse screen 34, situated below the screen feed conveyor 26, is inclined downwardly from an area adjacent the front of the trailer towards the rear of the trailer. A fine screen 36 is disposed below the course screen 34 with a similar downward inclination. The screens 34, 36 are power vibrated in a known manner by an eccentric rotating weight diagrammatically indicated at 37. The course screen 34 classifies by discharging oversize material to a top deck or upper side discharge conveyor 38 and the fine screen 36 classifies by discharging oversize material onto a bottom deck or lower side discharge conveyor 39. The side discharge conveyors 38, 39 each have horizontal endless belt surfaces and are selectively driven independently in either direction lateral to the lengthwise direction of the trailer 11.

Figure 2:
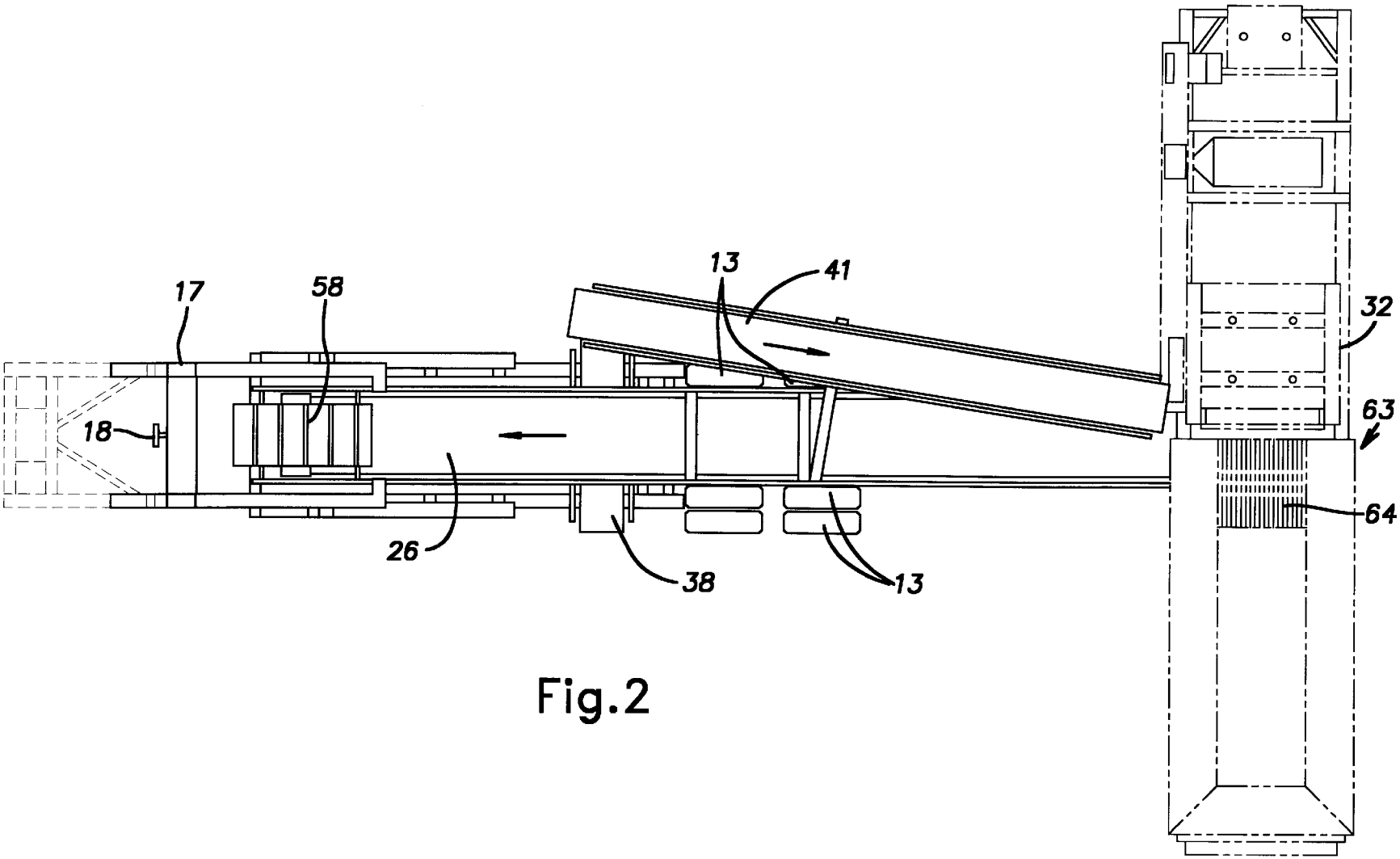
FIG. 2 is a somewhat schematic plan view of the screen plant of FIG. 1.

On one side of the trailer 11, an inclined return conveyor 41 has an endless belt 42 operating over end pulleys 42, 43. A frame 44 of the return conveyor 41 can be pivoted about its lower end through operation of a hydraulic cylinder 46 to raise this structure to the solid line position of FIG. 1 for operation and to lower it to the phantom position for transport at about 13' 6". The return conveyor 41 is inclined upwardly from an area below discharge zones of the side discharge conveyors 38, 39 to a discharge point above the crusher 32 (FIG. 2). Disposed below the fine screen 36 is a fines conveyor 47. This fines conveyor has an endless belt 48 operating around end pulleys 49, 51 with an upper reach inclined upwardly from the mid-length of the trailer 11 towards the front of the trailer. The fines conveyor 47 receives material of a particle size small enough to pass through the fine or second screen 36 and discharges such material at a zone generally indicated at 52 adjacent the front of the trailer 11.

A separator 56 for extracting magnetic material such as steel reinforcing bar or wire from the material being received on the screen feed conveyor 26 is carried on the articulated front section 17 of the trailer frame. The separator 56 includes a stationary magnet 57, which can be an electromagnet, surrounded by an endless belt 58 that is formed of hinged aluminum plate as is known in the industry. As illustrated, a lower reach 61 of the magnetic separator belt 56, in the operating position of the front trailer section 17, is generally horizontal and overlies the discharge end of the screen feed conveyor 26. The belt 58 travels around pulleys 59 in a clockwise direction as viewed in FIG. 1 so that a lower reach 61 moves in a forward direction with respect to the trailer configuration during operation. It will be understood from the description above that the main component or vector of travel of the upper reach of the screen feed conveyor 26 is in the same forward direction as that of the lower reach of the magnetic separator belt 58.

A plurality of hydraulic jacks 62 are mounted at spaced locations on the rear section 16 of the frame 12 and are used to rigidly support the frame during operation of the plant and remove the weight of the screen plant from the wheels 13.

The screen plant 10 operates in conjunction with a crushing plant 63 schematically shown in phantom in FIG. 2. The crushing plant 63, like the screen plant 10 is transported over regular highways to a desired work site. In the illustrated case, the screen plant 10 is set up perpendicular to the crushing plant 63 as viewed in plan from above (FIG. 2). Broken concrete, masonry, asphalt and the like can be loaded into a hopper/feeder 64 of the crushing plant 63. This material is crushed in the crusher 32 which may be a rotary unit as known in the art.

Initially, when the screen plant 10 is installed, the tail end 31 of the screen feed conveyor 26 is lowered from the vertical phantom position to the full line position (FIG. 1). The screen plant 10 is then backed up to locate this tail end of the conveyor 26 under the crusher plant 63 to receive material discharged from the crusher 32. Where the crusher plant 63 is used to crush material that includes reinforcing steel, a vibratory steel plate can be used to transfer material being discharged from the crusher 32 to the screen feed conveyor 26 to protect its belt from being struck by pieces of steel travelling at high velocities as they are thrown from the crusher.

Crushed material received at the lower end 31 of the screen feed conveyor 26 is carried on the belt 25 forwardly and upwardly towards the high end of this conveyor. Magnetic material such as steel reinforcing rod (rebar) or steel reinforcing wire is attracted off the conveyor belt 25 and is captured by the magnetic separator 56 when it enters the magnetic field of the separator. Crushed non-magnetic material falls over the upper end of the screen feed conveyor 26 and is reclined and classified by the screens 34, 36. Material reaching the side discharge conveyors 38, 39 can be discharged from the plant 10 or be re-crushed by directing it to the return conveyor 41. Magnetic material falls off the separator belt 58 at a zone 66 where the magnetic field is weak and is directed away by a chute 67.

The relatively high location of the pivot axis formed by the hinge pins 22 with respect to the elevation of a main length 69 of the rear frame section 16 permits the magnetic separator 56 to be swung up to a relatively high operating plane above the screen feed conveyor 26 when it is in its operative position. As shown, the pivot pins 22 are about vertically mid-way between the ground and the operating position of the magnetic separator 56. This advantageously accomplishes the extension and retraction of the magnetic separator 56 with a simple frame construction and simple actuating system. As shown in phantom in FIG. 1, in the transport position the magnetic separator 56 is in a generally vertical orientation in front of the screen feed conveyor 26.

The disclosed articulated trailer frame construction has the advantage, when deployed in the operating position, of providing clear access to the discharge zone of the fines conveyor 47 enabling this area to be serviced by a stacking conveyor or other machinery to efficiently remove material delivered by the fines conveyor.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

I claim:

1. A portable screen plant for a crusher comprising a trailer supported on wheels suitable for highway transport, an inclined screen feed conveyor on the trailer for conveying crushed material received at a lower end thereof and discharging the crushed material at an upper end thereof, a screen on the trailer for receiving material discharged from the feed conveyor and for classifying the same, and a magnetic separator on the trailer movable to an elevated operational position above the feed conveyor adjacent the discharge end thereof and to a retracted position lower than the operational position to provide adequate roadway height clearance during transport.

2. A screen plant as set forth in claim 1, including a power actuator to selectively move the magnetic separator between said operational and retracted positions.

3. A screen plant as set forth in claim 1, including support structure for said magnetic separator, said support structure being pivotal on said trailer to move said magnetic separator between said operational and retracted positions.

4. A screen plant as set forth in claim 3, wherein said trailer includes a frame, said frame being hinged at a point between a front section and a rear section thereof, said front section carrying a fifth wheel pin and said magnetic separator, said front section being pivotal about said hinge point.

5. A screen plant as set forth in claim 4, wherein said trailer includes a set of jacks to support said trailer on the ground off of said wheels during operation of said plant.

6. A screen plant as set forth in claim 4, wherein said front section of said frame is arranged to pivot through an angle of about 90°.

7. A screen plant as set forth in claim 4, wherein said hinge point has a vertical elevation generally midway between the ground and the operational position of the magnetic separator.

8. A screen plant as set forth in claim 1, wherein said screen feed conveyor is pivotal about a horizontal axis at a point adjacent its mid-length to raise the discharge end of the conveyor and lower the receiving end of the conveyor for operation and to lower the discharge end and raise the receiving end for transport.

9. A screen plant as set forth in claim 8, wherein said screen feed conveyor is generally aligned lengthwise with the longitudinal direction of the trailer.

10. A screen plant as set forth in claim 4, including a fines conveyor having an inclination in the same general direction as the inclination of said screen feed conveyor.

11. A screen plant as set forth in claim 10, wherein said fines conveyor is arranged to discharge fine material passing through said classifying screen to a zone generally underlying the front section of the trailer when the front section is in its operational position.

12. A portable screen plant for use with a portable crusher comprising a trailer having a frame, wheels mounted on the frame adjacent a rear of the trailer for highway transport of the trailer, a fifth wheel pin mounted on the frame adjacent the front of the trailer for coupling the trailer to a highway tractor, the frame having front and rear sections hinged together, a screen feed conveyor carried on the rear section of the frame and inclined upwardly from the rear of the trailer towards the front of the trailer, the screen feed conveyor at its lower rearward end being adapted to receive material discharged from a crusher and at its upper forward end being adapted to discharge material, at least one classifying screen disposed below the screen feed conveyor adapted to receive material discharged from the screen feed conveyor, a fines conveyor below the classifying screen to convey material passing through the classifying screen towards the front of the trailer, a power actuator to move the front frame section from a generally horizontal highway transport orientation to a generally vertical operational orientation, a magnetic separator mounted on the front frame section in a manner wherein it provides a relatively low height when the front frame section is in the transport position and wherein it overlies the screen feed conveyor when the front frame section is in the operational position whereby it is adapted to separate magnetic material from other material being conveyed by the screen feed conveyor.

13. A screen plant as set forth in claim 12, wherein the screen feed conveyor is pivotal at a location adjacent its mid-length on the rear trailer frame section about a horizontal axis in a plane perpendicular to the length of the trailer to enable the forward end of the screen feed conveyor to be lowered and the rear end to be raised for transport and to enable the forward end to be raised and the rearward end to be lowered for operation of the plant.

* * * * *